United States Patent [19]

Graham, Jr. et al.

[11] 4,365,464

[45] Dec. 28, 1982

[54] APPARATUS TO UNIFORMLY CONTROL WRAPPING A FILAMENT AROUND THE SURFACE OF A SPUN CORE YARN DURING RING SPINNING

[75] Inventors: Clarence O. Graham, Jr., New Orleans; Charles L. Shepard, Chalmette; Russell M. H. Kullman, Harahan, all of La.

[73] Assignee: The United States of America as represented by the Secretary of Agriculture, Washington, D.C.

[21] Appl. No.: 229,217

[22] Filed: Jan. 28, 1981

[51] Int. Cl.[3] ..... D02G 3/36

[52] U.S. Cl. ..... 57/12; 57/210

[58] Field of Search ..... 57/6, 12, 328, 210, 57/3, 224, 229

[56] References Cited

U.S. PATENT DOCUMENTS

| | | | |
|---|---|---|---|
| 2,332,395 | 10/1943 | Nutter et al. | 57/12 |
| 2,552,210 | 1/1948 | Parker | 57/328 |
| 2,854,812 | 10/1958 | Harris et al. | 57/12 X |
| 3,722,202 | 3/1973 | Audivert Indarte | 57/210 |
| 3,778,988 | 12/1973 | White et al. | 57/12 |
| 4,202,161 | 5/1980 | Foil, Jr. | 57/12 |

OTHER PUBLICATIONS

"Production of Air-Vortex Core-Spun Yarns directly from Card Sliver" by Grosicki, Z. J. et al., Textile Institute & Ind. J 17, pp. 288-289-8/79.

"Filament-Reinforced Differential Twist Yarn: A Comparison with Ordinary & Covered Waste Yarns", Audivert, R. et al., Textile Institute & Ind. J 17, pp. 286-287-8/79.

*Primary Examiner*—John Petrakes

*Attorney, Agent, or Firm*—M. Howard Silverstein; David G. McConnell; Raymond C. Von Bodungen

[57] ABSTRACT

An apparatus to uniformly wrap filament around the surface of a spun core yarn is disclosed. Means for fabricating a core yarn is provided. At the critical point of yarn fabrication, the spun core is simultaneously twisted or rotated on its longitudinal axis by means of ring spinning and contacted with a filament introduced by means of over-feed rollers. Helical wrapping of the filament around the surface of the staple core yarn takes place as the filament cohesively contacts the twisting core yarn to form a composite filament wound yarn.

5 Claims, 3 Drawing Figures

APPARATUS TO UNIFORMLY CONTROL WRAPPING A FILAMENT AROUND THE SURFACE OF A SPUN CORE YARN DURING RING SPINNING

BACKGROUND OF THE INVENTION

1. Field of the Invention

This invention relates to an apparatus for controlling filament wrapping of a spun core yarn.

2. Description of the Prior Art

In the prior art there has been increasing interest for the production of filament wrapped core-spun yarns and methods development related to said yarn production. Grosicki and Chylewska, Textile Institute and Industry Journal 17, pages 288–289, August 1979 are among the more recent researchers reporting their work in the field of core-spun yarns. These researchers utilize an air-vortex system to produce a core-spun yarn whereby the core is continuous filament yarns with a sheathing of natural fibers. While the benefits of their type yarn are cited the apparatus requires major mill modifications and uses vacuum in production which are undesirable for spinning mills equipped with ring spinning frames. Audivert and Fortuny, in the same issue as the cited work of Grosicki and Chelewska, discuss production of another means to produce a core-wrap type yarn called Differential Twist Yarns. The advantages of producing such yarn were enhanced tenacity and high production rate but the method requires a false-twist tube and is highly dependent on twist imparted to the yarn. Differential Twist Yarns are produced by first combining filament and staple fibers in the drafting zone then twisting further in the balloon zone with another filament. Three components are essential to the method of yarn production.

Audivert, U.S. Pat. No. 3,722,202, describes a method for producing blended yarns containing a staple fibrous core and a continuous man-made filament that is achieved on a ring spinning frame. In the Audivert process, feeding tension on the filament is important to the extent that not more than 0.5 g/tex should be employed. In the Audivert method, apparatus employed to obtain or control tension is not described nor are means to adjust tension described to achieve desired effect in the resultant composite wrapped yarn. Audivert, nevertheless claims a feeding tension is required in his method to produce desired effect of blending to obtain a wrapped yarn. To obtain tension on the filament, obviously a drag force must be used. Tensioning devices are inherent and require constant monitoring to assure binding effects are obtained with no part of the filament sinking into the fibrous core. Furthermore, Audivert teaches erroneous feeding methods which result in filament processed into the internal structure of the core yarn.

In contradistinction to prior devices, Parker, U.S. Pat. No. 2,552,210, avoided tensioning devices by merely feeding filament tension free. Parker accomplished tension free feeding through use of an upside down cone containing the filament yarn and points out tension is inevitable where a spun or twisted thread must turn a bobbin or spool for delivery. By employing the teachings of Parker, utilizing a tension free process, the filament goes into and out of the core as it is being spun thus partially covering the filament yarn.

An additional problem in the practice of the prior art is the point of combination of the filament with the core yarn. It is critical for the combination to occur at a sufficient distance from the exit of the nip of the front rolls of the drafting system of a ring spinning frame to preclude the filament from going into and out of the core as it is being spun, which is the object of Parker's teachings. The prior art teaches that the filament is combined with the staple fibers just as the two emerge from the front rolls of the spinning frame. Alternatively, the filament is passed through the apron rolls then through the front rolls. When passage through apron rolls occurs, the rolls must have a recessed center for slip drafting. None of the prior art can be practiced without considerable control and monitoring of tension. Further, no teachings of the prior art address the inherent problem of intertwining of the filament while the core is being spun because of the location of the combination point of the filament and the core yarn at the nip of the front rolls.

SUMMARY

We have now found that by suitably combining core yarn with filament at a critical thread guide contact point just prior to the ballon zone of core yarn formation where core yarn formation is essentially complete, we can significantly enhance external wrapping of filament around the core yarn. We have also found that separate filament feed rolls provide a means to assure a uniform flow of filament and maintain that flow without tensioning devices or constant monitoring.

Essentially, means is provided for drafting fiber into core yarn. This core yan is then fed through a contact guide and into a conventionally ring sprinning means. The ring spinner receives the core yarn, and spins and rotates it on its longitudinal axis. Simultaneously, filament is over-fed into the same contact guide as the core yarn where the filament is contacted with the outer surface of the core yarn cohesively. The result is a helical wrapping of the filament around the surface of the core yarn as the two are fed together into and through the spinning means.

Thus several problems associated with the prior art can be overcome. One problem of the prior art was the point of contact of the filament with the core yarn. It is critical for the combination to occur at a sufficient distance from the front rolls of the drafting system to preclude the filament from going into and out of the interior of the core as it is being spun. The prior art teaches that the filament is twisted around the staple fiber yarn as it emerges from the spinning frame. This is accomplished by passing the filament through the front draft rolls with the staple fiber but the point of combination of fiber core to filament is unknown and not controlled. Alternatively, in the prior art, the filament is passed through the apron rolls then through the front rolls. When passage through apron rolls occurs, the rolls must have a recessed center for slip drafting. None of the prior art can be practiced without considerable control and monitoring of tension. Further, no teachings of the prior art address the inherent problem of intertwining of the filament while the core is being spun because of the location of the combination point of the filament and the core. Internal wrapping of filament in the core yarn will definitely occur when combining the filament with uncompleted core yarn as is taught by all of the prior art.

In the instant invention, drafting of a staple core yarn is complete at the nip of the front rolls of the fiber drafting means. Twist or rotation around the longitudinal axis of the core yarn is put on an essentially completed core yarn just after leaving the drafting zone and prior to any contact with the filament. The filament is contacted only after completed formation of the core yarn thus internal wrapping of the filament into the core yarn is avoided. The prior art describes combinations of core yarn with filament either prior to the front drafting rolls or at the latest at the front drafting rolls: always prior to the critical point of entry of the thread guide. In the instant invention continuous filament is fed from preselected diameter feed rolls. The diameter of the filament feed rolls is 10% larger than the diameter of the core yarn feed rolls when both the yarn feed and filament feed rolls are on the same shaft axis. Thus the speed of feed of the filament is adjusted sufficiently greater to the speed of feed of the staple core yarn and allows for over-feed of the filament just enough to accomplish proper helical wrapping of the filament around the core yarn staple as the core yarn rotates on its longitudinal axis. The filament feed thus controls and assures uniform helical wrapping.

When the feed rolls of the filament feed and the feed rolls of the staple core yarn feed are on separate shaft axis, then the diameter of feed rolls of the filament can be the same or different from the feed rolls for the staple yarn feed, since the over-feed can be accomplished by speeding up the rotation of the filament rolls and thus the speed of the filament feed relative to the speed of the feed of the staple core yarn.

BRIEF DESCRIPTION OF THE DRAWINGS

FIG. I is a schematic front view of a ring spinning frame and illustrates one embodiment of the instant invention wherein the filament over-feed rollers and the feed rollers for the spun core yarn are on the same shaft axis.

FIG. II is an isometric detail showing the front rolls of FIG. I.

Figure 1:
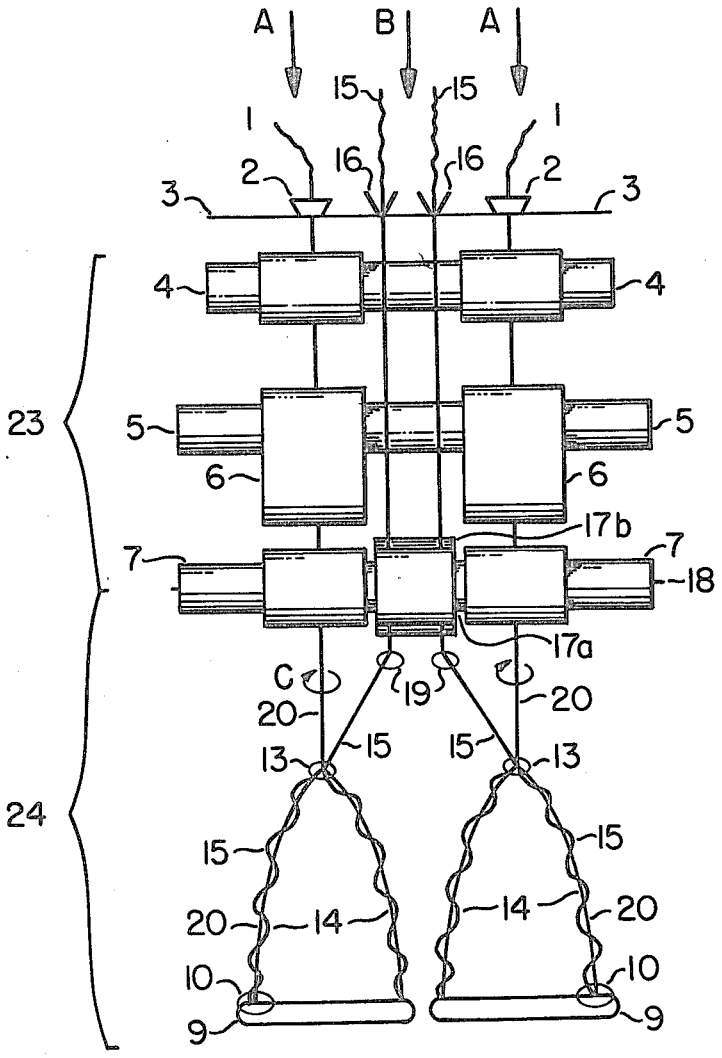
Figure 2:
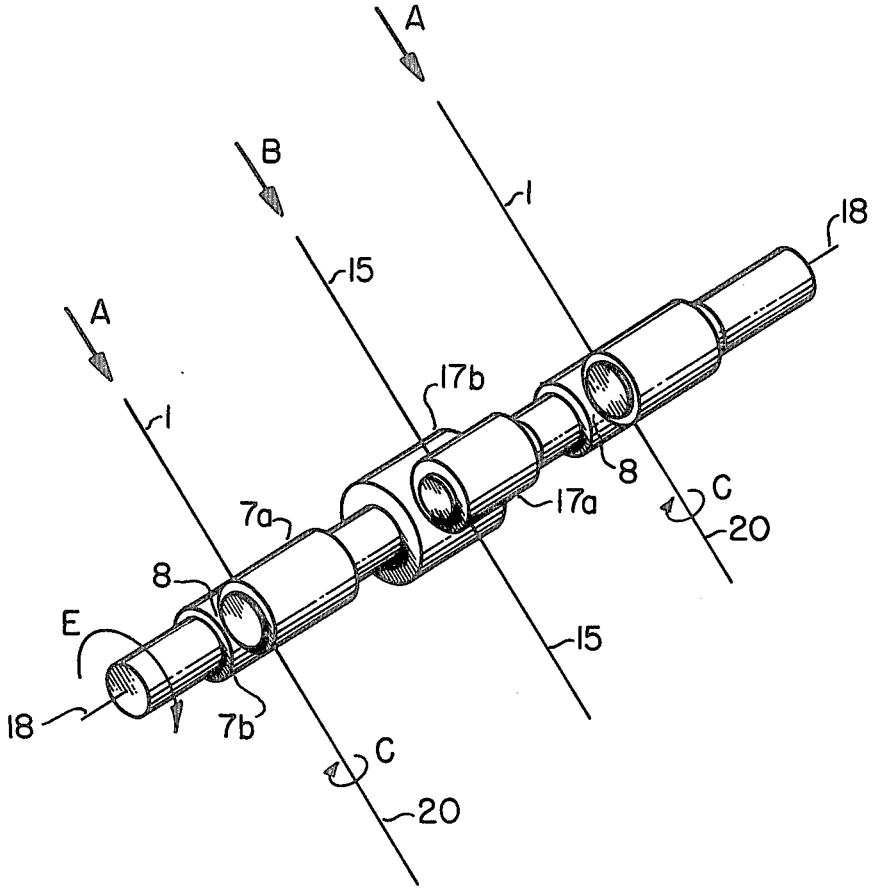
Figure 3:
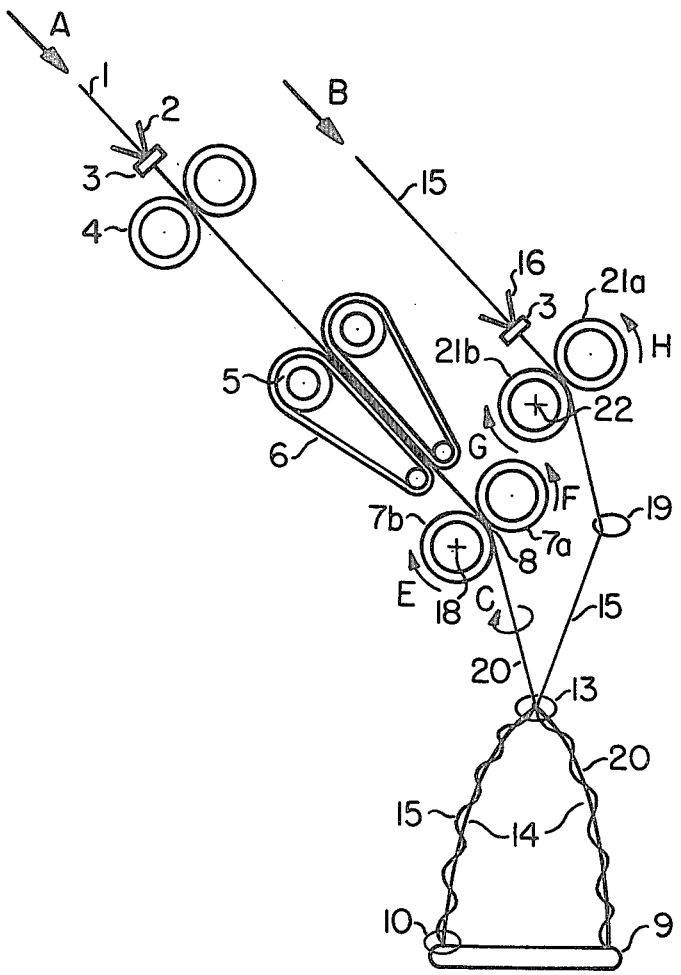

FIG. III is a diagrammatic side view of a second embodiment of the instant invention wherein the filament over-feed rollers and the feed rollers of the staple spun core yarn are on separate shaft axes.

DESCRIPTION OF THE PREFERRED EMBODIMENTS

In general, the instant invention consists of drafting a roving into a yarn and simultaneously wrapping a filament uniformly around the outer surface of the yarn during the ring spinning process. There are several critical aspects of the instant invention which must be adhered to in order to accomplish a uniform filament wrap of a spun yarn core. First, the proper diameter of yarn core to weight of filament must be correctly chosen in order to yield the optimum composite weight. Secondly, the point at which the filament is fed into the spinning process and combined with the yarn core is critical to assure uniform wrapping of the outer surface and avoid the filament from ever entering the actual staple yarn core. Third, the speed of the feed of filament must be balanced with the speed of the feed of the core yarn, by proper selection of the diameter of the roller which feeds the filament to the thread guide in order to achieve proper filament feed speed.

Referring now to FIGS. I and II wherein a staple yarn core is fabricated by introducing unspun staple fibers 1 into trumpet 2 which is mounted on a traversing bar 3 then into a drafting zone 23 consisting of back rolls 4, middle rolls 5, aprons 6, and then front rolls 7. The action on staple fibers 1 by drafting zone 23 is to form a staple fiber core 20. This is accomplished by stretching out or drawing staple fibers 1 and reducing the diameter of the staple fibers prior to passing through front rolls 7 and out at nip 8 which is the immediate exit of front rolls 7 to achieve properly formed staple core yarn 20. Nip 8 is critical to the process because it is at this point which twist of staple core yarn 20 begins. The twisting process begins at nip 8 of front rolls 7 and is typical for ring spinning processes. Staple core yarn 20 is essentially complete as it enters thread guide 13 where it balloons out and passes through balloon zone 14, through revolving traveler 10 which travels on ring 9 thus forming spinning means 24. The yarn is then spunt onto a bobbin (not shown).

Simultaneously, during the above described process for making staple core yarn 20, filament or multi-filament 15 is fed from a filament wound on a pirn or packaged mounted on a stationary or revolving spindle attached to the frame (not shown). Filament 15 is fed through trumpet 16 which is mounted on traversing bar 3, and bypasses rolls 4, 5, and aprons 6 and enters between top filament feed roller **17*a* and lower filament feed roller 17*b* (FIG. II). Lower filament feed roller 17*b* is designed with a diameter larger than front rolls 7 to increase the filament feed velocity and thus control uniform overfeed of filament 15 relative to the feed of staple core yarn 20. In this embodiment of the invention, lower roll 7*b* and lower filament feed roll 17(*b*) rotate on the same shaft and axis 18 and consequently both rotate at the same revolutions per minute. Lower feed roll 17(*b*) is optimally 10% larger in diameter than roll 7*b* in order to effect the correct rate of filament feed speed in relation to the core yarn feed speed and thus achieves uniform filament wrapping around the outer surface of staple core yarn 20. Thus, shaft axis 18 is driven by an external means (not shown) just as back rolls 4, and middle rolls 5. Filament 15 then passes through filament thread guide 19, (FIG. I) and then through thread guide 13 which is the critical point at which filament 15 cohesively contacts the outer surface of spun core yarn 20 and also the point at which wrapping of filament 15 around yarn 20 begins to take place. Filament thread guide 19 is thus located between the nip of rolls 17 and thread guide 13 which is the contact guide. Filament 15 then passes through revolving traveler 10 which travels on ring 9, and is then spun onto a bobbin (not shown) simultaneously with spun core 20. Helical wrapping of filament 15 uniformly around staple core yarn 20 occurs between contact thread guide 13 and the bobbin (not shown). This results from the optimum combination of critical parameters affecting the relationship of filament and spun core at this location. These critical parameters are the ratio of speed feed of staple core yarn 20, and twist of staple core yarn 20 in relation to speed of filament 15** feed. Therefore, the above results in a composite uniformily filament wrapped staple yarn on a bobbin accomplished during the conventional ring spinning process.

Referring now to FIG. III wherein a second embodiment of the invention is described. In this embodiment of the invention the yarn core producing apparatus is identical to the device described above. The main differences are in filament feed rollers **21*a* and *b*. Filament feed rollers 21*a* and *b* are located on a different axis from front rolls 7. Thus, roll 21*b* is driven (not shown) independently from front rolls 7. The first purpose for this embodiment is to accomplish greater flexibility and variation on the kinds and types of filament 15 which can be fed into the system. The second purpose is to vary the speed of filament feed roller 21***b* in relation to core yarn lower feed roller 7*b*. 7*a* is the core yarn upper feed roller. Thereby, one is able to produce a wider variety of composite filament wrapped yarns.

In this second embodiment, filament or multi-filament 15 is over-fed into the system by means of filament rolls 21*a* and 21*b*. Rolls 21*a* and *b* are mounted on shafts for an axis 22. It is important to note that shaft axis 22 for roller 21*b*, unlike the first embodiment, is different from that of roller 7*b* which is shaft axis 18. In this embodiment of the instant invention, filament feed roller 21*b* can be the same or larger in diameter than core yarn feed roller 7*b*. The overfeed is accomplished by means of adjusting the speed of rotation of roller 21*b* in relation to the revolutionary speed of roller 7*b*. This revolutionary speed differential between rollers 21*b* and 7*b* provides the optimum filament over-feed with respect to the core yarn feed. The result is uniformly wrapped filament 15 around staple core yarn 20.

Filament thread guide 19 is provided between the filament feed means 21 and contact guide 13 to feed filament 15 properly into contact guide 13 where filament 15 cohesively contacts the outer surface of core yarn 20 to allow for helical wrapping of filament 15 around yarn 20. The second embodiment of the instant invention works the same as the first in all aspects of the invention with the exception of this filament 15 feeding means.

In general, referring now to the figures, it should be noted that: A is the direction of feed of roving 1. B is the direction of feed of filament yarn 15. C is the direction of longitudinal rotation of staple core yarn 20. E and F are rotational directions for front rolls 7*b* and 7*a*. G and H are rotational directions for filament feed rolls 21*b* and 21*a*.

We claim:

1. An apparatus to uniformly control wrapping of a filament around the surface of a spun core yarn during ring spinnng comprising:

(a) means for drafting a fiber into a spun core yarn;

(b) means to feed the core yarn through a contact guide and into a ring spinning means;

(c) said ring spinning means to receive said core yarn, spin said core yarn, and rotate said core yarn on its longitudinal axis;

(d) means to over-feed a filament into the contact guide of (b) where the filament cohesively contacts the outer surface of the rotating core yarn, thus causing helical wrapping of the filament around the outer surface of the core yarn as the core yarn and filament are simultaneously fed through a balloon area located between the contact guide and ring spinning means.

2. The apparatus of claim 1 including a filament thread guide located between the means of over-feeding the filament and the contact guide.

3. The apparatus of claim 2 wherein the means of feeding the core yarn through a contact guide comprises: upper and lower rotating feed rollers, said upper and lower rotating feed rollers mounted on shafts for an axis.

4. The apparatus of claim 3 wherein the means to over-feed the filament into the contact guide comprises: upper and lower rotating over-feed rollers, said lower over-feed roller being 10% larger in diameter than said core yarn feed rollers, and said lower over-feed roller mounted on the correspondingly same shaft for an axis as the lower core yarn feed roller is mounted.

5. The apparatus of claim 3 wherein the means to over-feed the filament into the contact guide comprises: upper and lower rotating over-feed rollers, said over-feed rollers mounted on separate shafts for an axis than the shaft axis mountings of the core yarn feed rollers.

* * * * *